US008854443B2

(12) United States Patent
Kryger Nielsen et al.

(10) Patent No.: US 8,854,443 B2
(45) Date of Patent: Oct. 7, 2014

(54) MEDICAL SURGERY ROOM WITH COLOURED LIGHTING

(75) Inventors: Anders Kristian Kryger Nielsen, Solbjerg (DK); Jesper Durup, Otterup (DK)

(73) Assignee: Chromaviso IP ApS, Solbjerg (DK)

( * ) Notice: Subject to any disclaimer, the term of this patent is extended or adjusted under 35 U.S.C. 154(b) by 1201 days.

(21) Appl. No.: 12/451,266

(22) PCT Filed: Aug. 21, 2007

(86) PCT No.: PCT/DK2007/000381

§ 371 (c)(1), (2), (4) Date: Nov. 3, 2009

(87) PCT Pub. No.: WO2008/022640

PCT Pub. Date: Feb. 28, 2008

(65) Prior Publication Data

US 2010/0060726 A1 Mar. 11, 2010

Related U.S. Application Data

(60) Provisional application No. 60/839,072, filed on Aug. 21, 2006.

(30) Foreign Application Priority Data

Aug. 21, 2006 (EP) ..... 06017355

(51) Int. Cl.

| | |
|---|---|
| ***H01J 7/44*** | (2006.01) |
| ***H05B 37/02*** | (2006.01) |
| *F21W 131/205* | (2006.01) |
| *A61G 12/00* | (2006.01) |
| *A61G 13/00* | (2006.01) |

(52) U.S. Cl.

CPC ..... *H05B 37/02* (2013.01); *F21W 2131/205* (2013.01); *A61G 12/00* (2013.01); *A61G 13/00* (2013.01); *H05B 37/029* (2013.01); *A61G 2205/20* (2013.01)

USPC ..... 348/65; 607/88

(58) Field of Classification Search

None

See application file for complete search history.

(56) References Cited

U.S. PATENT DOCUMENTS

| | | | | |
|---|---|---|---|---|
| 5,093,769 | A * | 3/1992 | Luntsford | 362/269 |
| 6,601,985 | B1 | 8/2003 | Jesurun | |
| 2004/0052076 | A1 * | 3/2004 | Mueller et al. | 362/293 |
| 2006/0076908 | A1 * | 4/2006 | Morgan et al. | 315/312 |

FOREIGN PATENT DOCUMENTS

JP 2005-528733 A 9/2005

* cited by examiner

*Primary Examiner* — Ario Etienne
*Assistant Examiner* — Clayton R Williams
(74) *Attorney, Agent, or Firm* — James Creighton Wray

(57) ABSTRACT

A medical surgery or examination room and a method for illuminating such a room, wherein a substantial part of the room or the entire room is illuminated with colored lighting different from white lighting in order to achieve beneficial psychological effects or, primarily, to improve working condition. For example, green light may be provided behind the monitors used by a surgeon during operation and red light in a zone behind a surgeon during operation or examination. The lighting may be controlled by a computer with a touch screen interface.

12 Claims, 6 Drawing Sheets

MEDICAL SURGERY ROOM WITH COLOURED LIGHTING

This application claims the benefit of U.S. Provisional Application No. 60/839,072 filed Aug. 21, 2006, European Application No. 06017355.6 filed Aug. 21, 2006, and PCT/DK2007/000381 filed Aug. 21, 2007, which are hereby incorporated by reference in their entirety.

FIELD OF THE INVENTION

The present invention relates to a method for illuminating a medical surgery or examination room, where a number of light sources are in operation in the surgery or examination room, where the light sources generate light with different colours, where the light sources are controlled by at least one processor, where the processor regulates the light sources for generating light of different colours.

The present invention further relates to a medical surgery or examination room comprising a number of light sources, which light sources generate light with different colours, which light sources are connected to at least one processor, which processor regulates the light sources for generating light of different colours.

BACKGROUND OF THE INVENTION

Controlled lighting methods and apparatus are known from US 2004/0052076. Disclosed herein is found a method and a system for providing controlled lighting, including methods and systems for providing both white and non-white coloured lighting, including colour temperature controlled lighting. Such methods and systems include optical facilities for modifying light from a lighting unit, such as a LED-based lighting unit, including variable optical facilities and fixed optical facilities. Also provided are methods and systems for using multi-colour lighting units in a variety of commercial applications. Also provided are methods and systems for lighting control, including methods to assist lighting designers and installers to improve the quality of lighting in environments. Also provided are intelligent dimmers, switches, sockets and fixtures, as well as facilities for programming and using them. Also provided are various sensor-feedback applications of lighting technology, including sensor-feedback involving light sensors and forward voltage sensors. Also provided are lighting methods and systems that operate on time-based parameters.

In the medical sector, for example in hospitals, the desire for a clear, bright illumination is prevalent in order to see things as clear as possible. Especially in surgery rooms, it is recognised to be of vital importance that details can be seen by the surgeon and the other assisting personnel.

Lately however, in many surgery fields, there is a tendency to substitute the traditional surgery methods with so-called minimal invasive treatments, typically, conducted through small ports in the body of the patient, in contrast to the larger incisions typical of open surgery. Minimal invasive procedures are not only used in general surgery but also in specialities as gynaecology, neurosurgery, opthalmology, and radiology. Such procedures are called by a variety of adjectives, including endoscopic, laparoscopic, thoracoscopic and the like, but in the following, for simplicity, the term endoscopic will be used herein to describe these procedures.

In connection with such minimal invasive surgery treatments, the surgeon uses a number of endoscopic steering devices inserted into the body of the patient. In order to follow the operation, small endoscopic cameras are inserted as well, and the imaging is viewed on a computer display. Typically, the bright, white lighting in the surgery room is reflected in the display screen, which is why surgery rooms have been changed in order for the possibility to reduce the light intensity. However, while light intensity reduction is an advantage for the surgeon, it is a disadvantage for the personnel who are using other equipment in the room, for example the anaesthetists or the nurses who change the instruments during the operation.

OBJECT OF THE INVENTION

The object of the invention is to improve the lighting conditions for the surgery personnel. This is achieved by a surgery room, wherein a substantial part of the room or the entire room is illuminated with coloured lighting which is different from white lighting.

DESCRIPTION OF THE INVENTION

The object of the present invention can be fulfilled by a method as described in the preamble of claim 1 if the method is initially improved by performing at least the following steps of preparation by a processor:

a) determining the different tasks in an surgery or examination in a surgery or examination room;
b) determining the required personnel for each of the tasks;
c) determining the colour specific effect preferred by the personnel performing the specific tasks;
d) analysing which part of the room is used for the different tasks determined;
e) dividing the room into a number of zones depending on the specific tasks and the specific personnel;
f) assigning a specific colour to each of the zones in order to achieve the desired effects;

to illuminate the zones with light having the respective specific, assigned colours.

Hereby, it is achieved that before starting any activity in a surgery or examination room, decisions regarding the lighting selections in the different zones of the room are performed. In some cases the programming of the lighting may be rather simple in that the lighting value or combination can be used simply because a good lighting combination has been used for the same kind of surgery or examination in an earlier situation. In a situation where e.g. a new team of doctors and nurses have to start working in a surgery or examination room, they are able to change the illumination of the room with different lights in different zones within few minutes. The light in these zones can be programmed as soon as the personnel has performed the planning regarding where to place e.g. monitor screens, in order to achieve an arrangement where screens would be present to look at for the medical staff. Furthermore, depending on the kind of surgery or examination which is to be performed, the patients' well-being could also be part of the definition of the light in different zones in the room. A substantial part of the surgery and examinations are performed with a patient who is awake. In these situations, the patient's well-being is very important, and therefore, the light in the different zones should also be selected to promote his or her well-being. Furthermore, during an activity in the surgery or examination room, it is possible to change the light in the zones, which can be programmed into another colour or a different intensity.

The object can also be fulfilled in a surgery room or examination room as described in the preamble of claim 2 if the processor is initially programmed to perform at least the following steps:

a) determining the actual tasks of an activity in an surgery or examination room;
b) determining the required personnel for each of these tasks;
c) determining the colour specific effect preferred by the personnel performing the specific tasks;
d) analysing which part of the room is used for the different, determined tasks;
e) dividing the room into a number of zones depending on the specific tasks and the specific personnel;
f) assigning a specific colour to each of the zones in order to achieve the desired effects;

to illuminate the zones with light having the respective specific, assigned colours.

Programming the computer and in this way defining the different colours of light in different selected zones in the surgery or examination room can easily be done, and the processor can store this pre-programmed lighting programme, not only during the pending activity, but also for later use if the same staff are performing a similar surgery. During the surgery process a pre-programming is also possible, e.g. behind monitors it is possible in a given zone to adjust the colour until the correct contrast and light intensity is achieved so that focus will be on the monitors which are then performed in contrast to the background.

A computerised light control system is provided and functionally connected to a touch screen monitor for displaying a user interface in which a number of icons are provided, the icons being programmed to initiate a pre-programmed setup of the lighting in response to a single press action on the icon. The touch screen is a highly efficient way of programming the different selected zones. The touch screen can be cleaned easily on the surface, and it is also easy to adjust the lighting during surgery or examination if the colour or intensity of the light has to be changed for some reason in one or more of the zones.

A computerised light control system is provided which is programmed to change the temperature of the colour in dependence of predetermined criteria. There are different ways of defining the colour of light. A common way of defining colour is based on the wave length of light which is the most common technical way of defining the colour of light. Another way of defining the colour of light is to define a colour temperature. Colour temperature is being used to define light for e.g. film or television productions. In a studio, all lamps are typically adjusted to the same colour temperature, and the camera is adjusted to that specific temperature. Therefore, the adjustment of colour temperature is another way of adjusting the colour, but in some cases, this is the most efficient way of changing the colour in a defined zone. In a situation where e.g. television cameras are to be used during the surgery room, it could be very efficient to program the light into the correct colour temperature. The computerised system could be made in a way which allows changing between different ways of adjusting the light. It depends on the software used in the processor.

A number of lamps are provided, each lamp being capable of providing light with a large range of different colours due to a mixing of colours inside the lamp. Each lamp typically comprises at least three light sources, which light sources are selected e.g. red, green, blue, so that in combination, most of the possible colours are available. In addition to RGB light combinations, CMY light combinations are also possible. Surgery with e.g. LEDs, three or more LEDs in each lamp is preferred. Thereby, it is possible to use more than three different colours, and by using LEDs of different colours, a greater colour area of the total visible area of the human eye is achieved.

A computerised light control system is provided which is programmed to provide green light behind the monitors used by a surgeon during operation. Green coloured lighting reduces the uncomfortable reflection from computer screens. Experiments have shown that surgeons experience the operation, which may last several hours, as much more relaxed for their eyes if the surgery room has green lighting, than if the surgery room has white lighting.

Furthermore, a computerised light control system is provided which is programmed to provide red light in a zone behind a surgeon during operation or examination. The light zone behind the surgeon where the assisting staffs are working is advantageously red. Thus, in addition to the practical effect of light in surgery rooms, the psychological effects may play a very important role as well and may be used as such.

The pre-programmed setups are dependent on the predetermined position of a monitor configured for displaying the sequence of images from an endoscopic camera during a surgery or examination.

The step of assigning a specific colour to each of the zones also implies assigning a specific colour temperature to the colour.

The effect is psychological and related to working conditions. In terms of surgical intervention, it has been recognised that the mental state of the patient influences the outcome of the operation. When patients are brought into the surgery room, it is of importance that they are as relaxed as possible as stress situations are an uncomfortable experience for them. A warm, yellow light in the surgery room has been found to be of beneficial influence on patients. Thus, besides determining a specific colour for particular zones in the surgery room, the temperature of the colour can also be changed in accordance with predetermined criteria.

According to prior art, coloured lighting is generally used in a great variety of situations. Especially, the amusement industry is known for using coloured lighting in and outside buildings. Furthermore, coloured lighting is used in shops in order to underline certain promotional effects or to attract attention in general. However, to our knowledge, it has not yet been investigated whether coloured illumination in surgery rooms would be beneficial. The aim of having coloured lighting in medical surgery rooms is very different from its purpose in the other aforementioned areas. The use of coloured light in a medical surgery room creates better working conditions than the use of white light.

According to the invention, it is not necessary that the entire surgery room is bathed in light of the same colour. Advantageously, different zones of the room may have a specific light. For example, the light chosen behind the endoscopic monitors may be green in order for the surgeon to achieve a relaxed state in addition to the fact that the image quality of the endoscopic monitors as experienced by the eyes of the surgeon is optimised. The light behind the surgeon, where the assisting staff is working, can advantageously be red. Thus, in addition to the practical effect of light in surgery rooms, its psychological effects may play a very important role as well.

Furthermore, the anaesthetists may have their own light in another part of the room, and experiments have shown that white light is preferred by anaesthetists.

For different operations, different, staff specific light conditions are typically desired. In order to easily and quickly change from one set up to another, the lighting conditions may be computer controlled allowing for pre-programmed setups of the lighting in the surgery room to be chosen easily. Advantageously, the different programs are illustrated on a computer interface where selection of the different programs is possible by simple pointing actions, for example by a pointing action with a curser steered by a joystick, a computer mouse or by free hand gestures as described in US patent application No. US2004060037 by Tyrsted and in references therein. However, a touch screen is preferable, where special regions on the user interface for example in the form of icons optionally outlined as virtual buttons, are to be pressed in order to achieve a light change.

Such a screen may be mounted as a special, dedicated controller on the wall of the surgery room if a simple solution is desired. In an advanced embodiment, the controller for the computerised lighting is integrated in the display of a monitor used for other operative purposes as well and located in the vicinity of the surgeon. E.g. the light control may be achieved by an integrated solution using a personal computer.

The pre-programmed setups for the lighting in the surgery room may be programmed in dependence of the needs and desires of the specific surgeon who is to conduct the operation. Alternatively, the presets may depend on the kind of operation to be carried out. For different kinds of operations, the location of the surgeon is varying and so are the locations of the corresponding endoscopic monitors. The light may be changed accordingly. Furthermore, when a monitor position has to be changed during a surgery, a simple press on the virtual buttons on the touch screen changes the lighting in the room.

In a further development of the invention, the position of the monitor is automatically detected by a computerised lighting system which determines the location and the extension of the coloured, illuminated zones.

In an even further development of the invention, the different apparatuses and persons in the surgery room are automatically detected by the computerised lighting system, and lighting is automatically controlled and changed in accordance with the position of the personnel and/or the apparatuses. Detection can be performed, for example by automated camera surveillance in the room. Alternatively, detection can be performed by providing microwave detection in the room, for example as described by Mahmoud Tavakoli Shiraji & Shunsuke Yamamoto in the ECE 399 Project paper #1 with title "Human Tracking Devices: the Active Badge/Bat and Digital Angel/Verichip systems". In this project paper, ultrasound is used to track the position of people by triangulation of signals. Different kinds of tags, such as magnetic, electric or radio frequency tags can be used as well.

In a certain embodiment of the invention, the steps to be performed are:

- determining the different tasks for an operation in an surgery room and determining the related personnel for each of these tasks;
- determining a colour specific effect desired for each of the personnel performing the specific tasks;
- analysing which part of the room is used for the different tasks identified;
- dividing the room into a number of zones depending on the specific tasks and the specific personnel;
- assigning a specific colour to each of the zones in order to achieve the desired effects;
- illuminating the zones with light having the respective specific, assigned colours.

Lighting can be changed simply if lamps in the ceiling are capable of emitting light in different colours. Colour mixing in the lamps may be used in order to emit the correct colour from a specific lamp in the surgery room. A specific lamp may emit green light during a certain operation or for a certain time span during the surgical intervention and another light for another surgical intervention or for another time span during a surgical intervention.

According to the invention, surgery rooms have been provided, in which coloured light is used, on the one hand, to improve personnel working conditions and to comfort the patient and, on the other hand, to use the psychological effects of colours to create an overall more pleasant environment for the personnel. In addition, concentration and performance is improved.

The above-mentioned colours are only mentioned by way of example, and other colours may be used in the rooms according to the invention in accordance with the actual needs and desires in a given situation. For example, blue may be used with a psychologically calming effect.

DESCRIPTION OF THE DRAWINGS

The invention will be explained in more detail with reference to the drawings, wherein.

DETAILED DESCRIPTION OF THE INVENTION

Figure 1:
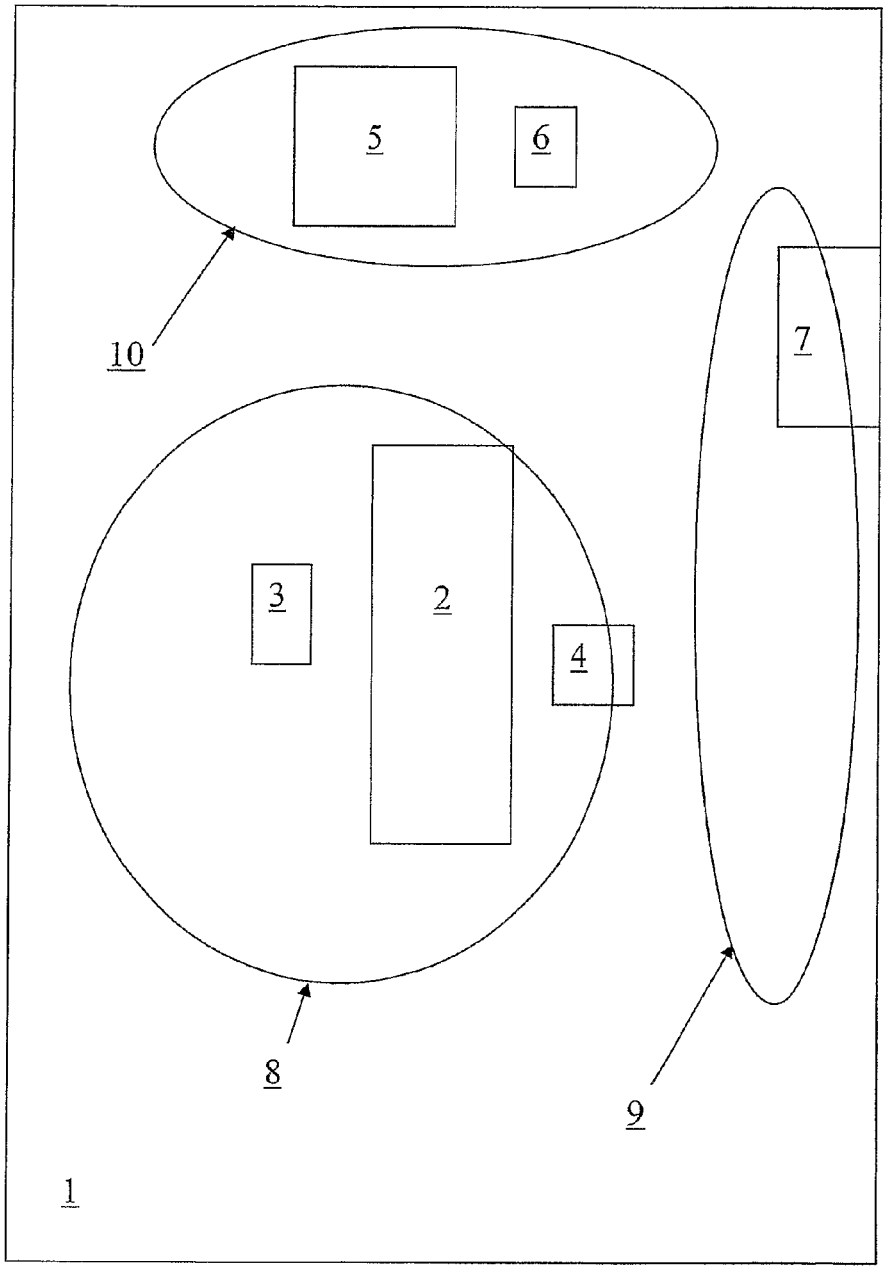
FIG. 1 illustrates a surgery room with different zones according to the invention.

FIG. 1 illustrates a surgery room 1 schematically. A surgery table 2 is typically located substantially in the middle of the room. The surgeon 4 is located on one side of the table, whereas the monitoring endoscopic screen 3 is located on the opposite side of the surgery table 2. The anaesthetists 6 with their equipment are located in the upper end of the room, whereas the assistants who provide surgery supplies from a storage facility 7 are located behind the surgeon. According to the invention, the room is divided into different zones 8-10, for example, as illustrated, with a first zone 8 enclosing the monitor 3, a second zone 9 around the anaesthetists' equipment 5 and a third zone 10 for the supply behind the surgeon 4. The first zone 8 may advantageously be green, the second zone 9 white or yellow, and the third zone 10 may be red. Other colours may be used and other zones may be added.

In order to obtain light in the different zones, lamps may be provided which are capable of adjusting the colour from a mixture of coloured light inside the lamp. In addition, the lamp can provide light as directed light cones such that a turning, tilting and mobbing of the lamp changes the direction and location of the light. This way, defined zones in the room can be illuminated in accordance with the desires.

Figure 2:
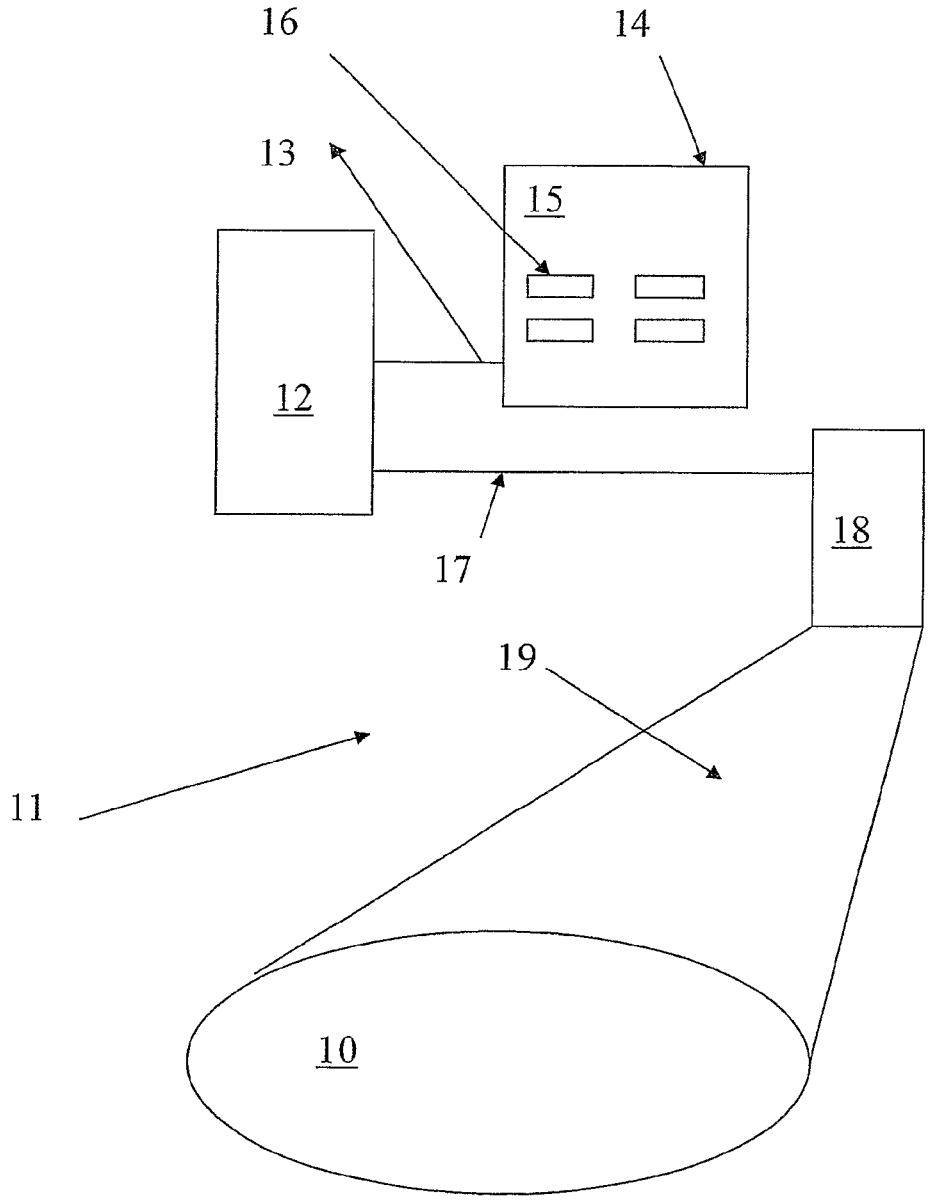
FIG. 2 illustrates a computerised lighting system according to the invention.

FIG. 2 illustrates the computerised lighting 11 system according to the invention. A computer 12 is electronically connected 13 to a touch screen display 14 showing a user interface 15 with virtual buttons 16, each of which is associated with a certain lighting configuration in the operation room 1. In dependence of the selection of the buttons in the user interface 15, different light scenarios are provided in the surgery room. For this task, the computer 12 is electronically connected to a lamp 18. The lamp 18 is configured to emit light of a preselected colour by colour mixing inside the lamp or by using appropriate light colour filtering. The light is emitted directional in a cane 19, for example by using prisms, lenses and/or mirrors, in order to provide light of a specific colour only in a certain zone 10 of the surgery room 1.

Figure 3:
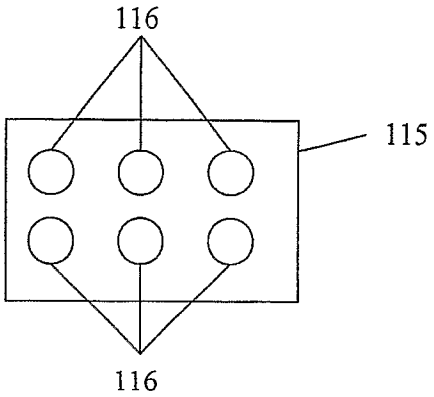
FIG. 3 illustrates a control unit according to the invention.

FIG. 3 illustrates a control unit 115 with controls 116 where each control represents a basic setting of the lighting in the surgery room. In this example, the control unit or control panel has six different basic settings. The number of controls 116 and hereby settings may differ from this number. The control unit may have more than six different settings, or it may have less than six different settings. Furthermore, it may be possible to adjust the colours and the intensity of the light by the control unit.

Figure 4:
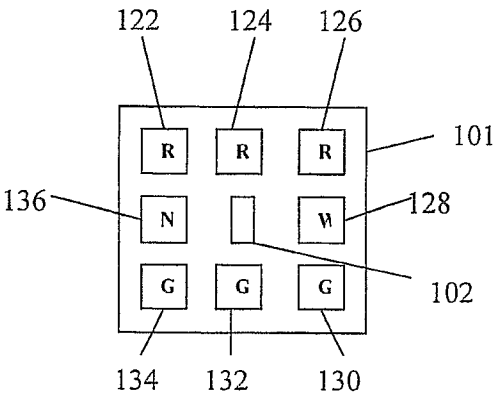
FIG. 4 illustrates a surgery room divided into zones with the surgery table in the middle according to the invention.

FIG. 4 illustrates a surgery room according to the invention. The surgery table 102 is placed in the middle of the room. FIG. 4 shows an example of the surgery room being divided into a number of zones. In this example, the number of zones is eight. Each zone 122, 124, 126, 128, 130, 132, 134 and 136 is assigned a specific colour. The colour represents the activity in that zone of the room. Thus, the individual zones are assigned a specific colour according to the activity in these specific zones. The letters in the different zones in the surgery room each represents a colour. G represents the colour green, R represents the colour red, W represents the colour white and N indicates that the light is turned off in that zone. As an example, the zone 134 is represented by the letter G which represents the colour green, where green is approximately in the range of 505-560 nm. The letter W in the zone 136 represents the colour white in this zone.

Figure 5:
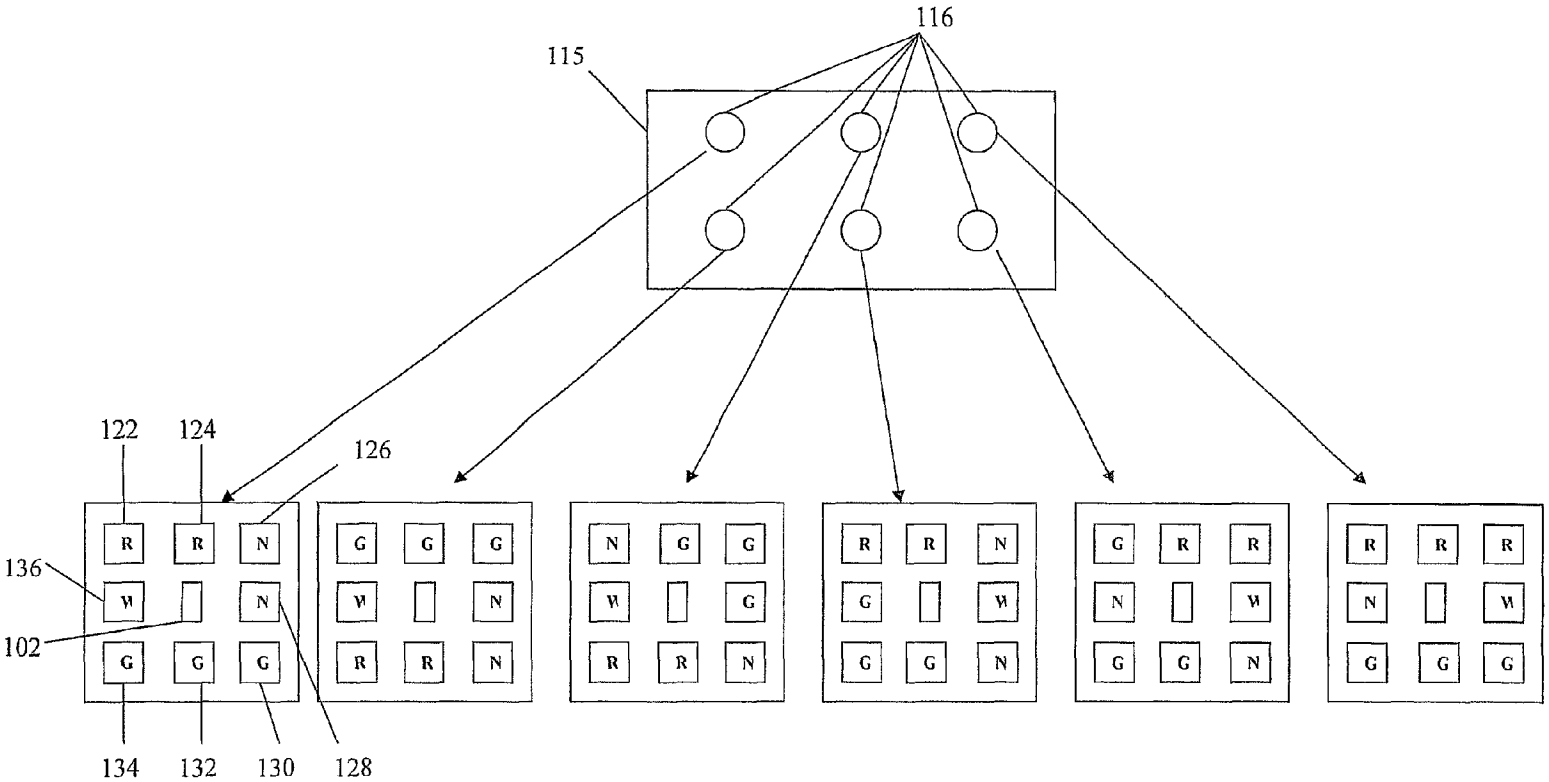
FIG. 5 illustrates the control unit and different selected settings for the surgery room according to the invention.

FIG. 5 illustrates an example of the entire setup of the system. Each control 116 on the control unit 115 represents a setup in the surgery room. This could be basic settings which can be chosen before an operation is initiated. The different kinds of surgery may be assigned a basic setting of the lighting in the surgery room. In FIG. 5, the numbers 122-136 represent the zones in the surgery room.

Figure 6:
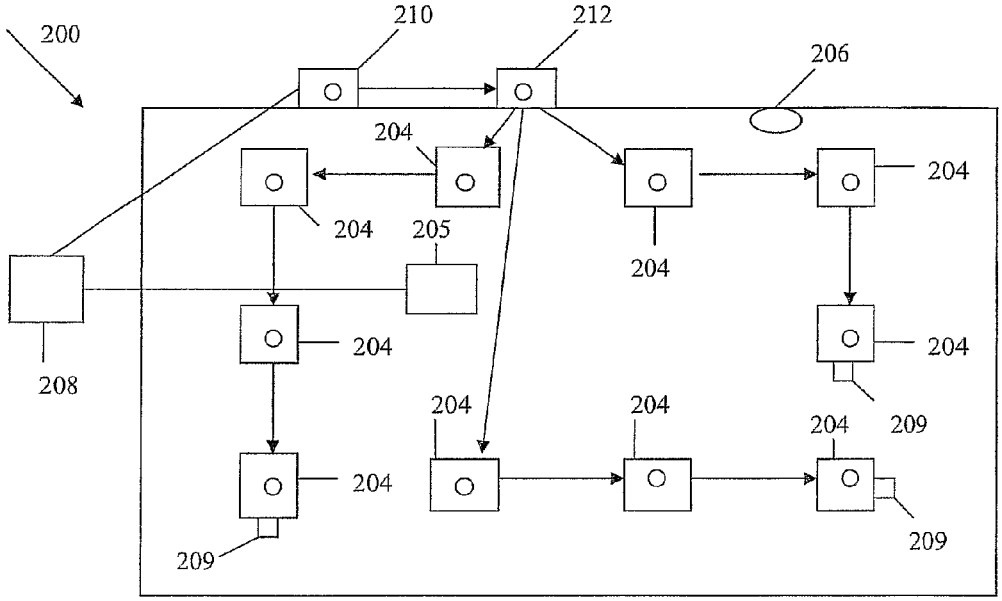
FIG. 6 shows a possible installation diagram.

FIG. 6 shows a possible installation diagram 200 for operating the lighting fixtures 204 from inside the sterile area 204. The figure shows a sterile area 202 which contains a number of light fixtures 204 where each light fixture might form a zone of light. Inside the sterile room 204 a touch screen 205 is shown for communicating with a controller 208. Further is an on/off switch 206 is shown. The light controller 208 is connected to a further controller 210 which controller 210 might be a controller device from a supplier of surgery equipment. From the controller 210, the light control signal is further transmitted to a DMX splitter 212. From here, DMX signals are transmitted towards the lighting fixtures 204. Some of the light fixtures 204 comprise terminations plugs 209 for connection towards further light fixtures.

In use, the installation diagram 200 will operate in a way where a controller 208 placed outside the sterile area controls the light fixtures 204. In the controller 208, a specific lighting session might be programmed, and in the controller 210, it is possible during operation inside the sterile room to change the settings according to settings predefined in the controller 208. In situations in the surgery room where further setting in the controller 208 is necessary, communication is necessary to persons placed outside the sterile area.

Figure 7:
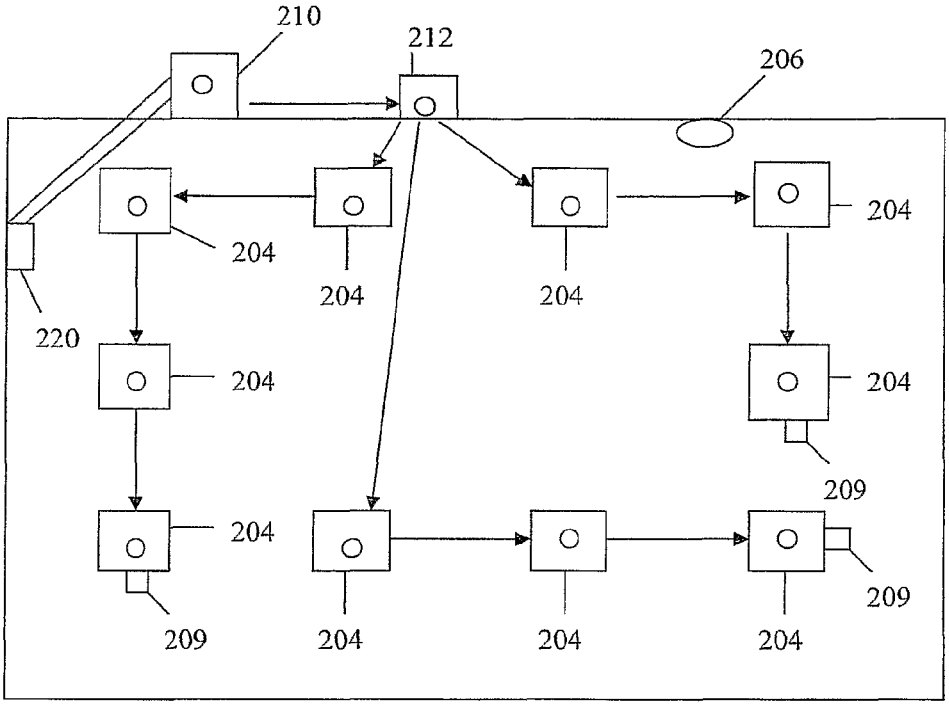
FIG. 7 differs from FIG. 6 in that the light control panel 220 is now placed inside the sterile area.

FIG. 7 only differs from FIG. 6 in that the light control panel 220 is now placed inside the sterile area. All functions are the same.

The invention claimed is:

1. A light control system for controlling coloured light in a medical treatment, surgery or examination room which is used for minimal invasive procedures, wherein a number of light sources are in operation in the surgery, medical treatment, or examination room, wherein the light sources generate light with a range of colours, said light sources are controlled by a computer system comprising a processor and a memory operatively connected to the processor, said computer system controls a colour of the generated light in the light sources, wherein the light sources form a plurality of independent controllable zones of controlled light, wherein said computer system is pre-programmed according to actual tasks for an activity in the medical treatment, surgery or examination room, further wherein said computer system is pre-programmed according to which part of the medical treatment, surgery or examination room is used for different tasks, said computer system is pre-programmed to assign a specific colour to each of the plurality of independent controllable zones of controlled light to achieve desired effects for personnel performing the different tasks in each of the plurality of independent controllable zones of controlled light, and wherein at least the following pre-programmed steps are executed by the computer system:

a) determining the different tasks for a medical treatment, surgery or examination in the medical treatment, surgery or examination room;
b) determining the personnel for each of the different tasks;
c) determining a colour specific effect desired for the personnel performing the different tasks;
d) analysing which part of the medical treatment, surgery or examination room is used for the different tasks determined;
e) dividing the medical treatment, surgery or examination room into the plurality of independent controllable zones of controlled light depending on the different tasks and the personnel for the different tasks; and
f) assigning a specific colour to each of the plurality of independent controllable zones of controlled light in order to achieve the desired effects for the personnel performing the different tasks in each of the plurality of independent controllable zones of controlled light; and to illuminate each of the plurality of independent controllable zones of controlled light with light having respective specific, assigned colours according to the different tasks to be performed in specific zones and according to a colour effect desired for performing the different tasks in specific ones of the plurality of independent controllable zones of controlled light.

2. The light control system for controlling coloured light in the medical treatment, surgery or examination room according to claim 1, wherein the computer system is provided and functionally connected to a touch screen monitor for displaying a user interface in which a number of icons are provided, the icons being programmed to initiate a pre-programmed setup of the light sources in response to a single press action on one of the icons.

3. The light control system for controlling coloured light in the medical treatment, surgery or examination room according to claim 1, wherein the computer system is provided which is programmed to change a temperature of a colour in dependence of predetermined criteria.

4. The light control system for controlling coloured light in the medical treatment, surgery or examination room according to claim 1, wherein the light sources are each capable of providing light with a range of colours due to mixing of colours inside each of the light sources.

5. The light control system for controlling coloured light in the medical treatment, surgery or examination room according to claim 1, wherein the computer system is provided which is programmed to provide green light behind monitors used by a surgeon during an operation.

6. The light control system for controlling coloured light in the medical treatment, surgery or examination room according to claim 1, wherein the computer system is provided which is programmed to provide red light in a zone behind a surgeon during an operation or an examination.

7. The light control system for controlling coloured light in the medical treatment, surgery or examination room according to claim 6, wherein the pre-programmed setups are dependent on a predetermined position of a monitor configured for displaying a sequence of images from an endoscopic camera during the operation or the examination.

8. A medical surgery and examination rooms according to claim 1, wherein a part or entirety of the medical treatment, surgery or examination room is illuminated with a coloured lighting different from white lighting.

9. A method for controlling coloured light generated by a number of light sources in a medical treatment, surgery or examination room which is used for minimal invasive procedures, comprising:

a) determining different tasks for a medical treatment, surgery or examination in the medical treatment, surgery or examination room;

b) determining required personnel for each of the different tasks;

c) determining a colour specific effect desired for the required personnel performing the different tasks;

d) analysing which parts of the medical treatment, surgery or examination room are used for the different tasks identified;

e) dividing the medical treatment, surgery or examination room into a number of zones depending on the different tasks and the required personnel;

f) assigning a specific colour to each of the zones in order to achieve desired effects for the required personnel performing tasks in each of the zones; and to illuminate the zones with light having respective specific, assigned colours according to the different tasks to be performed in the zones and according to the colour specific effect desired for performing the different tasks in the zones; and wherein steps a)-f) are implemented by a processor coupled to a memory.

10. The method according to claim 9, wherein the step of assigning a specific colour to each of the zones also implies assigning a specific colour temperature.

11. The method according to claim 9, wherein respective specific, assigned colours according to the different tasks to be performed in each of the zones have effect that is psychological or related to working conditions.

12. A method for illuminating a medical treatment, surgery, or examination room in connection with minimal invasive procedures, wherein a number of light sources are in operation in the medical treatment, surgery, or examination room, wherein the light sources generate light with different colours, comprising:

a) determining different tasks to be performed before, during and after a medical treatment, surgery, or examination in the medical treatment, surgery, or examination room;

b) determining a colour specific effect desired for personnel performing the different tasks, characterized by a step of providing the light sources in lamps, wherein each of the lamps comprises at least three light sources;

c) determining required personnel for each of the different tasks;

d) analysing which of a number of zones of the medical treatment, surgery, or examination room are used for the different tasks identified;

e) dividing the medical treatment, surgery, or examination room into the zones depending on the different tasks and the required personnel;

f) assigning a specific colour to each lamp of the zones in order to achieve the colour specific effect desired; which assigning provides green light behind monitors used by a surgeon during an operation, and a red light in a zone behind a surgeon during an operation or examination;

g) illuminating the zones with light having respective specific, assigned colours; and wherein steps a)-g) are implemented by a processor coupled to a memory.

* * * * *